US008448784B2

(12) United States Patent
Collins

(10) Patent No.: US 8,448,784 B2
(45) Date of Patent: May 28, 2013

(54) CIGARETTE PACKAGE

(75) Inventor: Timothy Paul Collins, London (GB)

(73) Assignee: Japan Tobacco Inc., Tokyo (JP)

( * ) Notice: Subject to any disclaimer, the term of this patent is extended or adjusted under 35 U.S.C. 154(b) by 27 days.

(21) Appl. No.: 12/962,975

(22) Filed: Dec. 8, 2010

(65) Prior Publication Data

US 2011/0100846 A1 May 5, 2011

Related U.S. Application Data

(63) Continuation of application No. PCT/JP2009/060953, filed on Jun. 16, 2009.

(30) Foreign Application Priority Data

Jun. 26, 2008 (JP) ..... 2008-167282

(51) Int. Cl.
*B65D 85/10* (2006.01)

(52) U.S. Cl.
USPC ..... 206/268; 229/160.1

(58) Field of Classification Search
USPC ..... 206/265, 268, 271, 272; 229/126, 229/130, 160.1
See application file for complete search history.

(56) References Cited

U.S. PATENT DOCUMENTS

| | | | | |
|---|---|---|---|---|
| 2,803,394 | A * | 8/1957 | Ringler | 229/160.1 |
| 2,826,295 | A * | 3/1958 | Janson | 206/250 |
| 2,951,626 | A * | 9/1960 | Weiss | 229/160.1 |
| 3,214,009 | A * | 10/1965 | Tamarin | 206/250 |
| 5,429,295 | A * | 7/1995 | Levy | 229/130 |
| 6,457,580 | B1 * | 10/2002 | Focke et al. | 206/259 |
| 7,156,228 | B2 * | 1/2007 | Brizzi et al. | 206/268 |
| D582,264 | S * | 12/2008 | Snyder | D9/423 |
| 8,011,501 | B2 * | 9/2011 | Biondi et al. | 206/268 |
| 2010/0270185 | A1 * | 10/2010 | Berger et al. | 206/268 |
| 2010/0320101 | A1 * | 12/2010 | Biondi et al. | 206/268 |

FOREIGN PATENT DOCUMENTS

| | | | |
|---|---|---|---|
| DE | 91 05 089 | U1 | 6/1991 |
| EP | 0 596 225 | A2 | 5/1994 |
| EP | 0 693 441 | A1 | 1/1996 |
| JP | 49-96333 | | 8/1974 |
| JP | 5-213340 | A | 8/1993 |
| WO | WO 2006/102945 | A1 | 10/2006 |

OTHER PUBLICATIONS

Written Opinion of the International Search Authority, dated on Jul. 28, 2009, issued in PCT/JP2009/060953.

* cited by examiner

*Primary Examiner* — David Fidei

(74) *Attorney, Agent, or Firm* — Birch, Stewart, Kolasch & Birch, LLP

(57) ABSTRACT

A cigarette package includes a box (2) having an opening (4) at an upper end thereof, a lid (8) joined to one side edge of the opening (4) by means of a hinge (6), and a pull flipper (18) capable of being pulled out from inside the box (2). When the lid (8) is opened, the pull flipper (18) forms a pop-up wall (20) extending from the lid (8) to the opening (4) of the box (2).

9 Claims, 5 Drawing Sheets

CIGARETTE PACKAGE

CROSS REFERENCE TO RELATED APPLICATION

This application is a Continuation of PCT International Application No. PCT/JP2009/060953 filed on Jun. 16, 2009, which claims priority under 35 U.S.C. 119(*a*) to patent application Ser. No. 2008-167282 filed in Japan, on Jun. 26, 2008. The entire contents of all of the above applications is hereby incorporated by reference into the present application.

TECHNICAL FIELD

The present invention relates to cigarette packages for accommodating cigarette products such as cigarettes and filter cigarettes.

BACKGROUND ART

As cigarette packages of this type, hinged-lid packages are widely used. A conventionally known hinged-lid package includes a box having an opening at an upper end thereof, and a lid joined to the opening of the box by means of a hinge. The lid is swung about the hinge to open and close the opening of the box (Patent Document 1).

Patent Document 1: Japanese Laid-open Patent Publication No. 05-213340

DISCLOSURE OF THE INVENTION

Problems to be Solved by the Invention

The aforementioned type of hinged-lid package has been in use for many years. Accordingly, the hinged-lid package no longer has such novelty in its opening/closing mode as to stimulate users' willingness to buy the package. Also, the area that can be spared for advertisement out of the outer surface of the cigarette package is significantly limited, and therefore, an adequate amount of information about the cigarette product cannot be displayed on the outer surface of the cigarette package.

An object of the present invention is to provide a cigarette package which has a novel opening/closing mode and at the same time can secure an ample display area for information about a cigarette product.

Means for Solving the Problems

To achieve the above object, a cigarette package according to the present invention comprises: a box having a shape of a rectangular parallelepiped and having a rectangular opening at an upper end thereof; a lid joined to one side edge of the opening of the box by means of a hinge, the lid being configured to open and close the opening when the lid is swung about the hinge; and a pull flipper hanging down from the lid, wherein, when the lid is closed, the pull flipper is accommodated in the box, and when the lid is opened, the pull flipper is pulled out of the box through the opening and provides a pop-up wall extending from the lid to the opening of the box.

In the above cigarette package, the lid is swung about the hinge in the width direction of the box to open and close the opening of the box. In the case of ordinary hinged-lid packages, on the other hand, the lid is swung in the back-and-forth direction of the box to open and close the opening of the box.

Thus, the lid opening/closing mode of the cigarette package of the present invention greatly differs from that of ordinary cigarette packages.

Also, when the lid is opened, the pull flipper causes the pop-up wall to emerge from inside the box. The pop-up wall imparts a distinctive impression to the open posture of the lid. Further, the pop-up wall can be used as a display area for displaying advertisement of a cigarette product or information on the product.

Specifically, the pop-up wall has a shape of a circular sector of which a center of a circle coincides with the hinge. In this case, the pop-up wall has a central angle of 90° and has a radius equal to a width of the opening of the box. The pop-up wall configured in this manner not only permits the pull flipper to be pulled out of the box, that is, the lid to be smoothly opened and closed, but also secures a large area for the display area.

The box includes a box body having an open end, and an inner frame partly projecting from the open end and forming a front edge and other side edge of the opening, and the lid has a shape of a rectangular parallelepiped and has an open end capable of meeting the open end of the box body. In this case, the open end of the box body includes a front edge and a side edge that allow the front edge and the other side edge of the opening to be exposed, respectively, and the front and side edges of the open end have slanting portions, respectively, that form a generally U-shape when the front and side edges are expanded.

This shape of the open end significantly differs from that of the open end of an ordinary box body, thus imparting a distinctive outer appearance to the box body.

The inner frame has a recess formed in an upper edge thereof and extending from the front edge of the opening over to the other side edge of the opening. The recess provides the inner frame with what is called an access opening. The access opening of the present invention extends over to the other side edge of the opening, as distinct from the access opening of ordinary cigarette packages, and therefore, the cigarette package of the present invention takes on a distinctive external appearance. Specifically, the recess includes a front portion located at the front edge of the opening and having a shape similar to that of the front edge of the open end.

Advantageous Effects of the Invention

In the cigarette package of the present invention, the lid opens and closes the opening of the box by being swung about the hinge not in a back-and-forth direction of the box, but in a direction from side to side of the box. Also, when the lid is opened, the pull flipper is pulled out of the box and causes the pop-up wall to appear between the lid and the opening of the box. Thus, the cigarette package of the present invention has a distinctive opening/closing mode, and also the pop-up wall provides a wide area for displaying advertisement of the cigarette product or information about the product, separately from the outer surface of the cigarette package.

MODE FOR CARRYING OUT THE INVENTION

Figure 1:
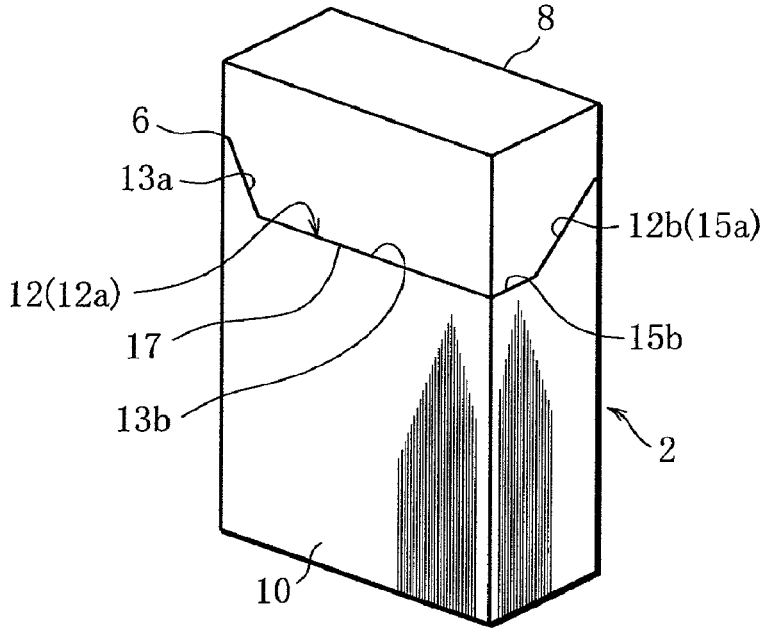
FIG. 1 is a perspective view showing a closed state of a cigarette package according to an embodiment.
Figure 2:
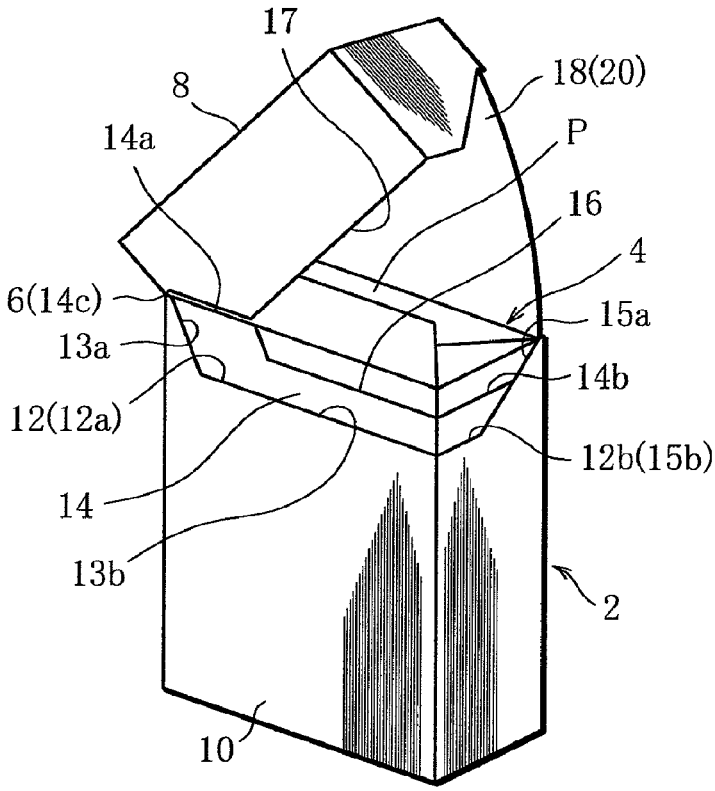
FIG. 2 is a perspective view showing an opened state of the package of FIG. 1.

Referring to FIGS. 1 and 2, there is illustrated a cigarette package according to one embodiment. The cigarette package comprises a box 2 in the form of a rectangular parallelepiped, and the box 2 has a rectangular opening 4 at an upper end thereof. A lid 8 in the form of a rectangular parallelepiped is joined by means of a hinge 6 to one side edge of the opening 4, that is, the left-hand side edge of the opening 4 as viewed in FIGS. 1 and 2. The lid 8 is swung about the hinge 6 to open and close the opening 4 of the box 2.

Specifically, the box 2 includes a box body 10 having an open end 12 at an upper end thereof. The lid 8 is joined to the left-hand side edge of the open end 12 by the hinge 6.

Further, the box 2 includes an inner frame 14 arranged inside the box body 10 and partly projecting from the open end 12. The inner frame 14 is in the form of the letter U, as viewed in a cross section of the box body 10, and has a front edge 14*a* and a pair of side edges 14*b* and 14*c* at an upper part thereof. The inner frame 14 forms the opening 4 of the box 2 in cooperation with the open end 12. Specifically, the opening 4 is defined by the hinge 6 of the open end 12, the rear edge of the open end 12, and the front edge 14*a* and the side edge 14*b* of the inner frame 14. The front edge 14*a* is parallel with the rear edge of the opening 4, and the side edge 14*b* is parallel with the hinge 6. The side edge 14*c* is located so as to closely adjoin the hinge 6.

The open end 12 further has a front edge 12*a* and a side edge 12*b*, and the front and side edges 12*a* and 12*b* are located at a level lower than the front and side edges 14*a* and 14*b*, respectively, of the inner frame 14. Namely, the inner frame 14 projects in part from the front and side edges 12*a* and 12*b*.

When the front edge 12*a* and the side edge 12*b* are expanded on an identical plane, the front and side edges 12*a* and 12*b* cooperatively form a generally U-shape. Specifically, the front edge 12*a* has a slanting portion 13*a* located close to the hinge 6 and slanting downward from the hinge 6, and a horizontal portion 13*b* extending from the slanting portion 13*a* in the width direction of the front wall of the box body 10. On the other hand, the side edge 12*b* has a slanting portion 15*a* located close to the rear edge of the opening 4 and slanting downward from the rear edge, and a horizontal portion 15*b* extending from the slanting portion 15*a* in the width direction of the side wall of the box body 10. The horizontal portions 13*b* and 15*b* meet at the boundary between the front and side walls of the box body 10.

When the lid 8 is closed, the lid 8 is fitted over the projecting part of the inner frame 14, and as is clear from FIG. 1, an open end 17 of the lid 8 meets the open end 12.

Further, the inner frame 14 has a recess 16 in an upper edge thereof, and the recess 16 is formed so as to extend from the front edge 14*a* over to the side edge 14*b*. As clearly shown in FIG. 2, that portion of the recess 16 which is located at the front edge 14*a* has a shape similar to that of the front edge 12*a*, with the remaining portion of the front edge 14*a* located close to the hinge 6.

An inner pack P is contained in the box 2. The inner pack P includes a bundle of 20 filter cigarettes and a wrapper wrapping the bundle therein. The aforementioned opening 4 and the recess 16 not only allow the top surface of the inner pack P to be exposed but also allow the front and side surfaces of the inner pack P to be partly exposed. The recess 16 makes it easy to take out a filter cigarette from the box 2.

Further, as shown in FIG. 2, the lid 8 is provided with a fin, or a pull flipper 18. When the lid 8 is opened, the pull flipper 18 is pulled out of the box 2 and forms a pop-up wall 20 extending from the rear edge of the open end 17 of the lid 8 to the rear edge of the opening 4 of the box 2. Specifically, the pull flipper 18 has an upper end joined to the inner surface of the rear wall of the lid 8 and hangs down from the lid 8 toward the box 2. When the lid 8 is closed, the pull flipper 18, that is, the pop-up wall 20 is accommodated in the box body 10 and inserted between the rear wall of the box body 10 and the inner pack P.

Figure 3:
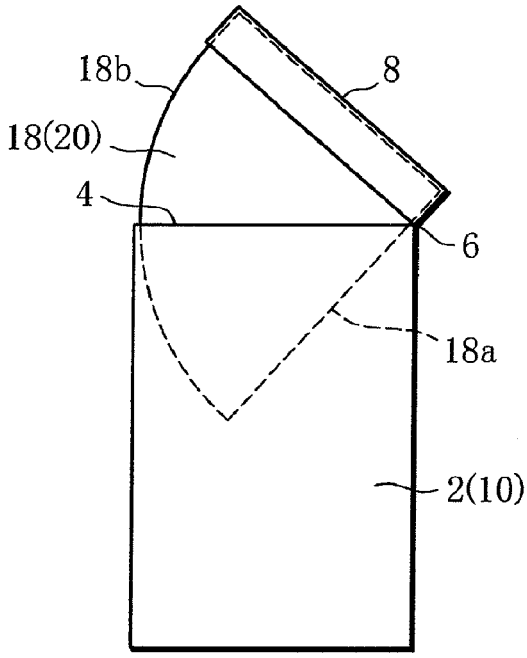
FIG. 3 is a rear view of the package of FIG. 2.

More specifically, as clearly shown in FIG. 3, the pop-up wall 20 is in the form of a fan, namely, a circular sector of which the center of the circle coincides with the hinge 6. The sector is formed by a straight-line edge 18*a* extending from the hinge 6, and an arcuate edge 18*b* connecting between the distal end point of the straight-line edge 18*a* and the lid 8.

In this embodiment, the fan-shaped pop-up wall 20 has a central angle of 90°, and the length between the hinge 6 and the arcuate edge 18*b*, that is, the radius of the pop-up wall 20 is equal to the width of the opening 4. Further, paper out of which the pull flipper 18 is made is harder than a blank for forming the box body 10, and the thickness of the pull flipper 18 is larger than that of the blank.

In the cigarette package described above, the hinge 6 permits the lid 8 to swing not in a back-and-forth direction of the box 2, but in a direction from side to side of the box 2. Namely, the lid 8 is swung in a sideways direction of the box 2 to open and close the opening 4 of the box 2. Consequently, the cigarette package of this embodiment provides a novel opening/closing mode significantly different from that of ordinary hinged-lid packages.

Further, when the lid 8 is opened, the pull flipper 18 causes the pop-up wall 20 to appear between the lid 8 and the opening 4 of the box 2. The pop-up wall 20 provides the cigarette package of the embodiment with a unique opening mode, thus further raising users' motivation to buy the package.

The pop-up wall 20 is fan-shaped and has a radius equal to the width of the opening 4. Thus, when the lid 8 is opened, the pull flipper 18 is pulled out of the entire width of the opening 4 and shows the pop-up wall 20 with a large area covering the region between the lid 8 and the opening 4 of the box 2.

The front and rear surfaces of the pop-up wall 20 can be used to display advertisement and information about products, and such display serves to further stimulate users' buying motivation. Moreover, the pull flipper 18 functions as a guide for guiding the opening/closing motion of the lid 8, so that the user can smoothly open and close the lid 8.

Figure 4:
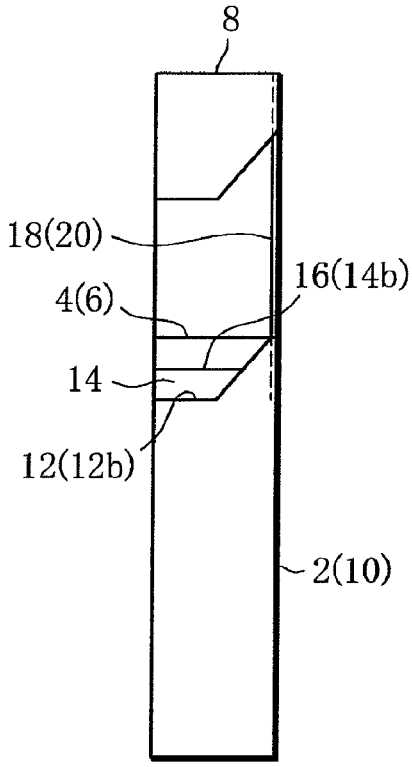
FIG. 4 is a side view of the package of FIG. 2.

Furthermore, the recess 16 of the inner frame 14 extends from the front edge 14*a* over to the side edge 14*b* of the inner frame 14, as is clear from FIG. 4. This permits a filter cigarette to be extracted not only from the front of the box 2 but also from the side of the box 2, making it easier for the user to take out a filter cigarette.

Figure 5:
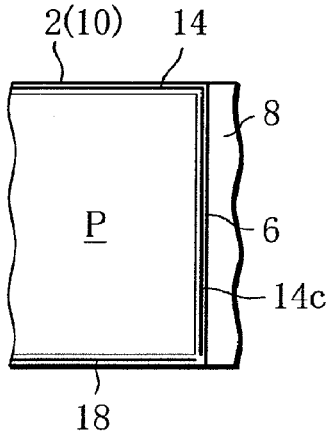
FIG. 5 illustrates the positional relationship between a hinge and a side edge of an inner frame.

As shown in FIG. 5, moreover, the side edge 14*c* of the inner frame 14 is arranged along the hinge 6 and thus serves as a reinforcing member for the hinge 6, that is, a liner for improving the durability of the hinge 6. Accordingly, even if the lid 8 is repeatedly opened and closed before all of the filter cigarettes in the inner pack P are consumed, stable opening and closing of the lid 8 can be ensured.

It is to be noted that the present invention is not limited to the foregoing embodiment alone.

Figure 6:
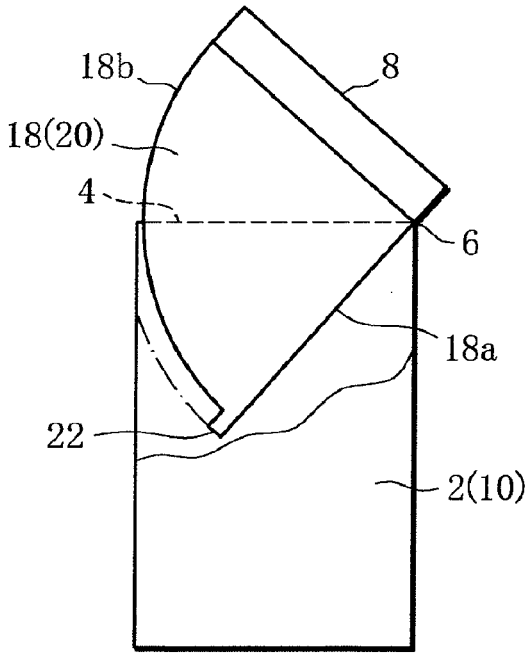
FIG. 6 illustrates a modification of the cigarette package.

For example, as shown in FIG. 6, the pull flipper 18 may have a protrusion 22 formed at the distal end of the straight-line edge 18*a*. When the pull flipper 18 is pulled out of the box 2 as the lid 8 is opened, the protrusion 22 collides with the inner surface of the side wall of the box 2, thus determining the opening angle by which the lid 8 is swung open. Namely, the protrusion 22 functions as a stopper for preventing the pull flipper 18, that is, the pop-up wall 20, from coming out of the box 2.

The protrusion 22 may alternatively be formed on the arcuate edge 18*b* of the pull flipper 18. In order to secure a large opening angle of the lid 8, however, it is preferable that the protrusion 22 should be located at the distal end of the straight-line edge 18*a*.

Also, the pull flipper 18, that is, the pop-up wall 20 may have a shape different from a circular sector. Further, the shape of the open end 12 of the box body 10 as well as the shape of the upper end of the inner frame 14 may be changed as desired.

Explanation Of Reference Signs

2 box
4 opening
6 hinge
8 lid
10 box body
12 open end
12*a* front edge
12*b* side edge
14 inner frame
14*a* front edge
14*b* side edge
16 recess
18 pull flipper
20 pop-up wall

The invention claimed is:

1. A cigarette package comprising:

a box having a shape of a rectangular parallelepiped and having a rectangular opening at an upper end thereof, the opening being defined by a front wall, a rear wall and two side walls of said box;

a lid joined to one side edge of the opening of the box through a hinge, the lid having a shape of a rectangular parallelepiped and being configured to open and close the opening when the lid is swung about the hinge; and a pull flipper hanging down from a rear wall of said lid, wherein, when the lid is closed, the pull flipper is accommodated in the box, and when the lid is opened, the pull flipper is pulled out of the box through the opening and provides a pop-up wall extending from the lid to the opening of the box, said pop-up wall having the shape of a circular sector in which the center of the circular sector coincides with the hinge, wherein the box includes a box body having an open end, and an inner frame partly projecting from the open end and forming a front edge and other side edge of the opening allowing the front edge and the other side edge of the opening to be exposed, and the lid has an open end capable of meeting the open end of the box body, and wherein the front and side edges of the open end have slanting portions, respectively, that form a generally U-shape when the front and side edges are unfolded.

2. The cigarette package according to claim 1, wherein the circular sector has a central angle of 90°.

3. The cigarette package according to claim 1, wherein the pop-up wall has a radius equal to the width of the opening.

4. The cigarette package according to claim 1, wherein the inner frame has a recess formed in an upper edge thereof and extending from the front edge of the opening over to the other side edge of the opening.

5. The cigarette package according to claim 4, wherein the recess includes a front portion located at the front edge of the opening and having a shape similar to that of the front edge of the open end.

6. The cigarette package according to claim 1, wherein said pull flipper further has a stopper for determining an opening angle of said lid when said lid is opened.

7. The cigarette package according to claim 6, wherein the stopper protrudes from an arc-shaped periphery of said pull flipper, the stopper colliding with an inner surface of the side wall of said box when said lid is opened.

8. The cigarette package according to claim 7, wherein the stopper is located at an end of the arc-shaped periphery of said pull flipper.

9. The cigarette package according to claim 1, wherein the inner frame further has a side edge arranged along the hinge.

* * * * *